United States Patent [19]

Reis

[11] 4,243,857

[45] Jan. 6, 1981

[54] CONTROL DEVICE

[75] Inventor: Robert D. Reis, Hingham, Mass.

[73] Assignee: United Electric Controls Company, Watertown, Mass.

[21] Appl. No.: 944,413

[22] Filed: Sep. 21, 1978

[51] Int. Cl.[3] ..... H01H 35/32

[52] U.S. Cl. ..... 200/83 C; 200/81.4; 200/302; 200/330

[58] Field of Search ..... 200/81.4, 82 C, 83 R, 200/83 B, 83 C, 83 J, 83 P, 83 Y, 302, 330

[56] References Cited

U.S. PATENT DOCUMENTS

| | | | |
|---|---|---|---|
| 2,507,065 | 5/1950 | Trautman | 200/82 C |
| 2,777,028 | 1/1957 | Kendall et al. | 200/83 J |
| 2,961,507 | 11/1960 | Higgs | 200/83 Y |
| 3,052,777 | 9/1962 | Meisenheimer, Jr. et al. | 200/83 J |
| 3,056,004 | 9/1962 | Davis | 200/83 Y |
| 3,085,140 | 4/1963 | Roe | 200/302 |
| 3,128,354 | 4/1964 | Conery | 200/83 Y |
| 3,898,405 | 8/1975 | Weber | 200/83 J |

*Primary Examiner*—Stephen Marcus

*Attorney, Agent, or Firm*—Robert T. Gammons

[57] ABSTRACT

A control device wherein the component parts comprising a switch or switches, expandable bellows and a kinematic train for transmitting expansion or contraction of the bellows to the switch or switches for actuating the same are removably contained in separate compartments in a fully-gasketed, weathertight enclosure, but are readily accessible in their respective chambers for adjustment, removal and replacement. The switch or switches are sealed within a hermetically-sealed receptacle within the enclosure and operation of the switch or switches is effected without breach of the receptacle by displacement of a flexibly displaceable portion of the wall of the receptacle. The kinematic train includes means for effecting displacement of the flexibly displaceable wall portion and may include a Belleville washer assembly to impart snap action to the kinematic train and to hold it in its operative and inoperative positions. When two switches are employed, the kinematic train includes a lever assembly for effecting operation of the switches simultaneously or sequentially.

19 Claims, 17 Drawing Figures

CONTROL DEVICE

BACKGROUND OF INVENTION

In many industrial processes, particularly the petrochemical industry, there are highly corrosive and highly explosive atmospheres. It is the purpose of this invention to provide a control device which will be substantially completely resistant to corrosion, substantially explosion-proof and wherein its component parts are readily accessible for replacement, repair and adjustment independently of each other.

SUMMARY OF INVENTION

As herein disclosed, the device comprises a fully-gasketed enclosure containing chambers within which there are situated in operative relation to each one or more switches and conductors, sensing means and a kinematic train for transmitting response of the sensing means to the switches to actuate same. The switch or switches and portions of the conductors are hermetically sealed within a receptacle contained in one of the chambers to repress arcing of the contacts and to minimize corrosion and the kinematic means is designed to transmit the movement of the sensing means to the switching means in the receptacle without physical intrusion or penetration of the receptacle. The receptacle is a can comprised of a corrosion-resistant metal within which the switch or switches are mounted and the conductors extend from the top of the can through headers sealed in epoxy resin. The switches have actuating pins spaced from the bottom of the can and means for adjusting the spacing. The sensing means is a bellows, one end of which is held stationary. The other end of the bellows is movable, is held distended from the stationary end by a spring and is exposed within its chamber to compression and expansion by changes of pressure within the chamber. The kinematic means in one form comprises a direct acting actuator rod connected at one end to the bellows so as to be moved thereby and with its other end supported adjacent the bottom of the can; and lever means at the bottom of the can for transmitting the movement of the actuator rod from outside the can to inside the can to actuate the switches therein. The said means comprises at the bottom of the can a flexible portion to the outer and inner sides of which are fixed lever arms so positioned that the distal end of the outer lever arm is at the center overlying the upper end of the actuator rod and the distal end of the inner lever arm lies beneath the switch pin. Optionally, a Belleville washer assembly is interposed between the upper end of the actuator rod and the lever arm at the outer side comprising a spring-biased plunger which will supply snap action to the on and off movement of the lever arms to render the control substantially immune to vibration. In another form wherein it is desirable to selectively actuate the switch or switches simultaneously or in succession, the bottom of the can is provided with two pairs of lever arms, one pair for each switch, and linkage interposed between the actuator rod and the bottom, movable in consonance with the actuator rod or in seriatim. Provision is made for adjusting the resistance of the spring in the sensor to compression to cover a relatively long range, provision is made to adjust the gap between the actuator rod and the lever arm to control the pressure at which the actuator rod will become effective, provision is made for presetting the Belleville washer assembly to snap at a predetermined pressure and provision is made for varying the interval between actuating the first and second switches when they are to be operated in seriatim. The chamber containing the switch means and conductors has a removable top cover to permit repair and replacement, the chamber containing the kinematic means has a removable front cover for permitting adjustment, repair and replacement and the bottom chamber in which the sensing means is contained is removable to provide access to the sensing means. The device will now be described in greater detail with reference to the accompanying drawings, wherein:

Figure 1:
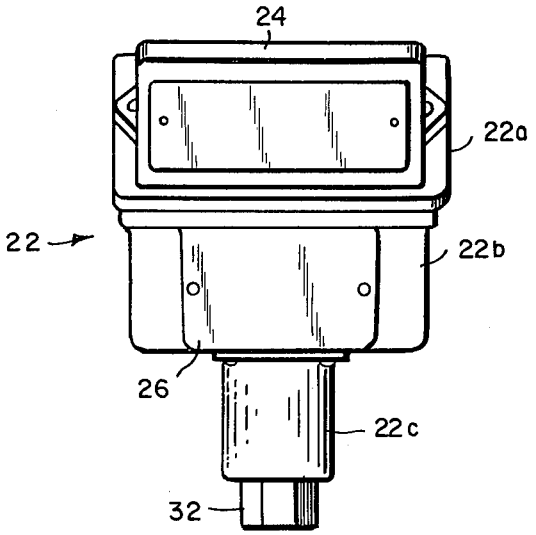
FIG. 1 is a front view of the control device.
Figure 2:
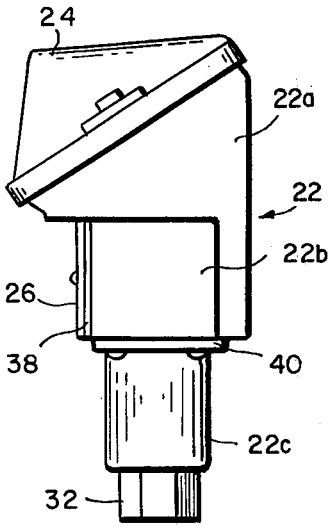
FIG. 2 is a side view as seen from the right side of FIG. 1.
Figure 3:
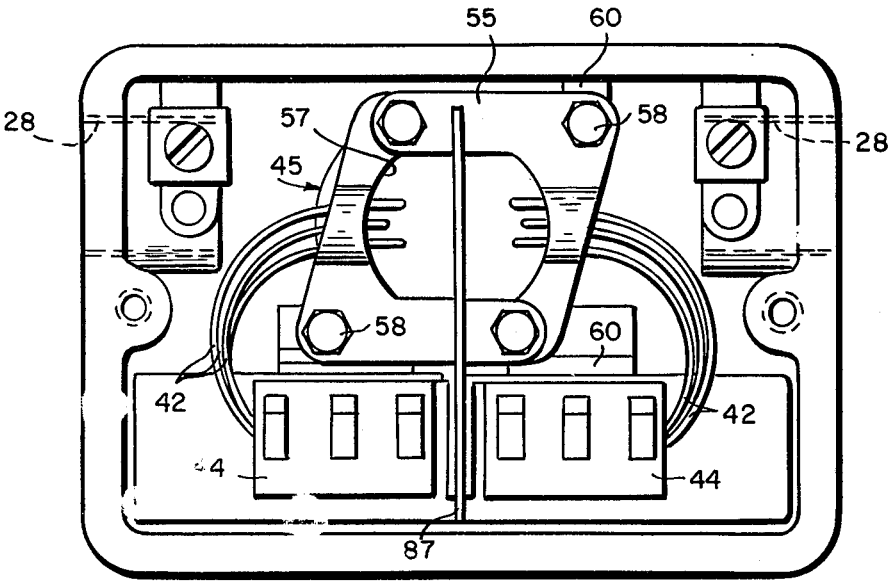
FIG. 3 is a top view of the control device to larger scale with the cover removed.
Figure 5:
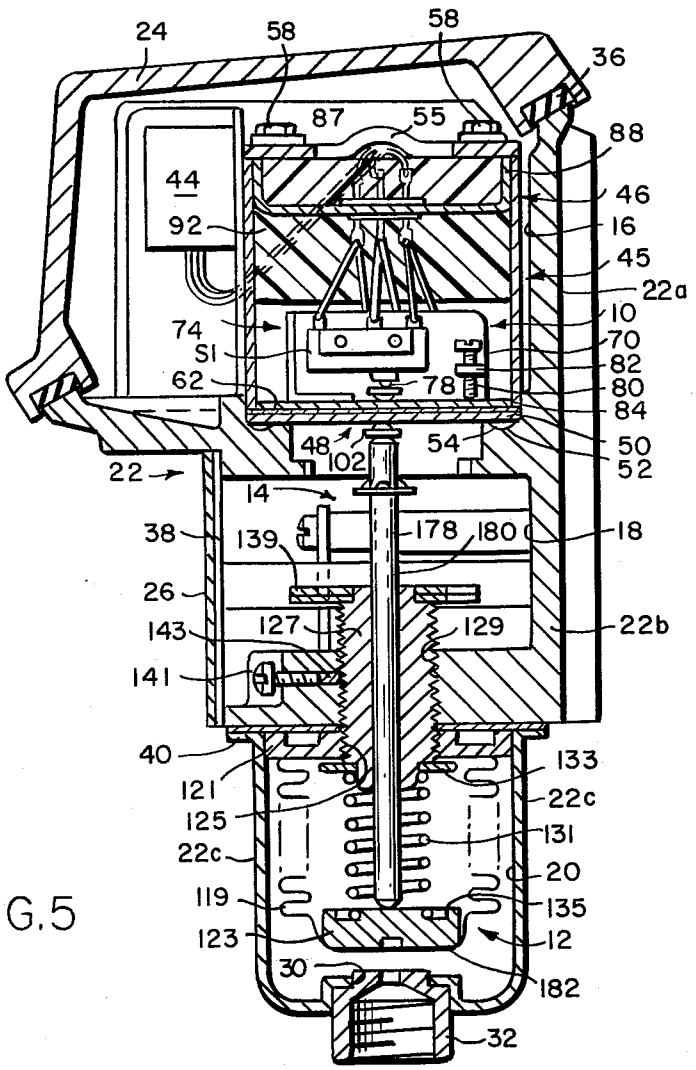
FIG. 5 is a vertical section taken on the line 5—5 of FIG. 4.
Figure 4:
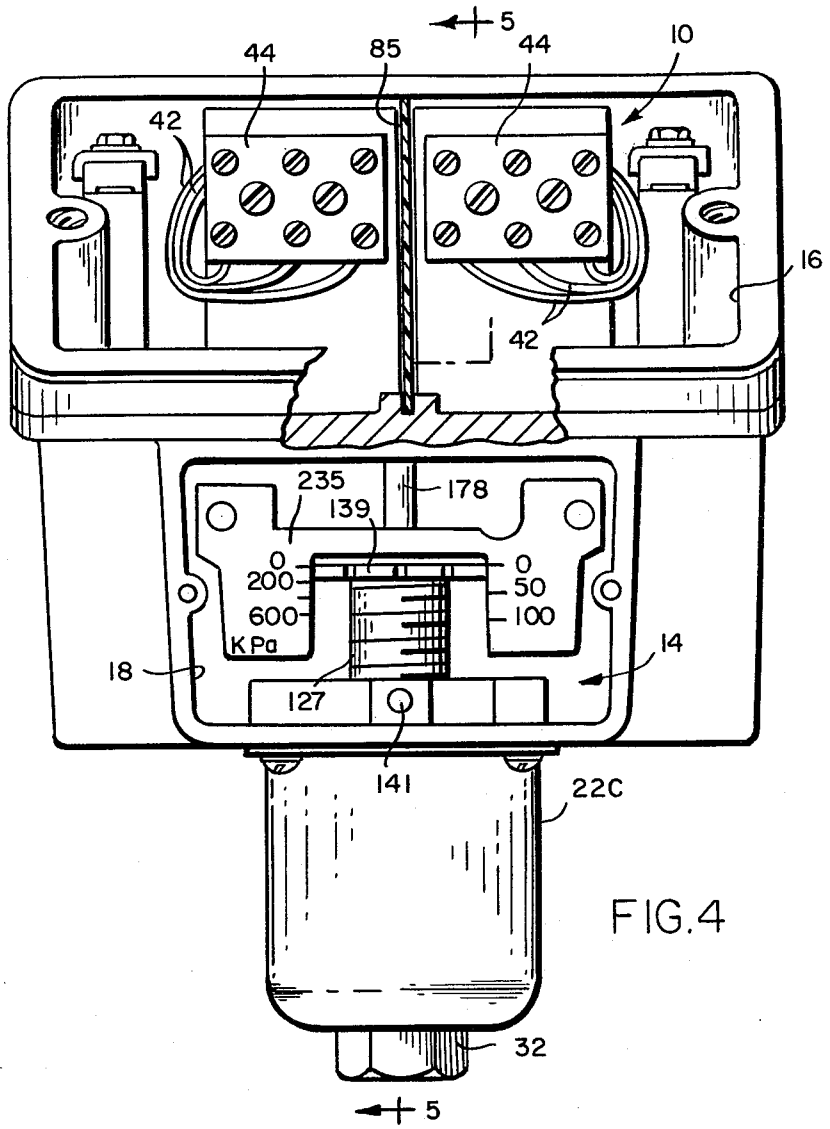
FIG. 4 is a front elevation of the device to the same scale as FIG. 3 with the cover removed.

Referring to the drawings, FIG. 5, the control device comprises essentially switch means 10, sensing means 12 and kinematic means 14 for transmitting the movement of the sensing means 12 to the switch means 10 to effect actuation of the latter. The several component parts 10, 12 and 14 of the control device are housed separately in chambers 16, 18 and 20 of an enclosure 22 comprising an upper part **22*a* provided with a removable cover 24, an intermediate part 22*b* provided with a cover 26 at the front side and a lower part 22*c* removably bolted to the lower end of the intermediate part 22*b*. The side walls of the part 22*a* contain conduit openings 28—28 for receiving cable ends by means of which the device is connected into the circuit which is to be controlled and the part 22*c* contains an opening 30 within which there is mounted a threaded coupling 32 for receiving a pressure line. There is a sealing gasket 36 for the cover 24, a sealing gasket 38 for the cover 26** and a sealing gasket 40 at the junction of the part 22*c* with the part 22*b*. The several component parts 10, 12 and 14 can thus be readily removed and replaced independently of each other and as will appear later, readily independently adjusted.

Figure 6:
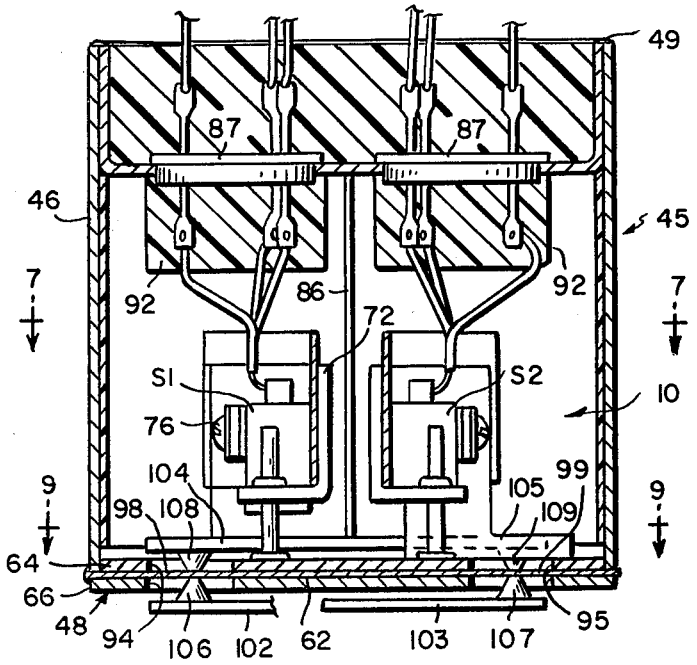
FIG. 6 is a diametral section of the switch-containing can removed from the upper part of the control device.
Figure 7:
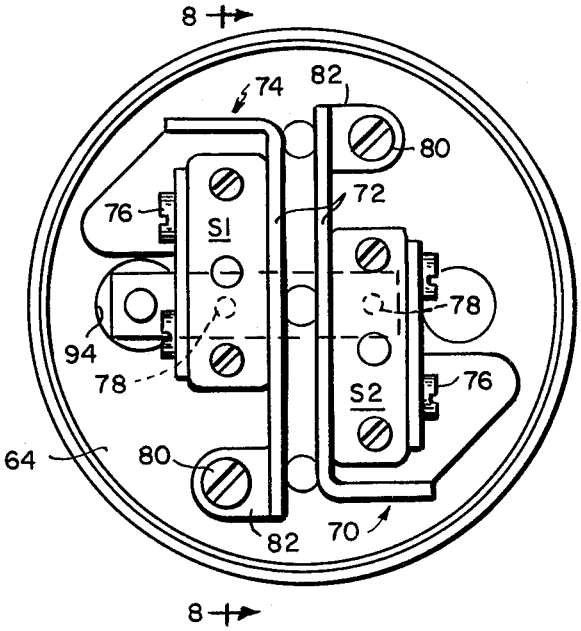
FIG. 7 is a horizontal section taken on the line 7—7 of FIG. 6.

The switch means 10, FIGS. 5, 6 and 7, comprises one or two snap switches S1,S2, lead wires 42—42 and terminal blocks 44—44. The lead wires 42—42 connect the contacts of the snap switches with the terminal blocks and the latter are provided with quick-connecting means, not shown, for connection to the cable ends.

In accordance with this invention, the snap switches S1 and S2 and portions of the lead wires 42—42 extending therefrom to the terminal blocks 44—44 are hermetically sealed within a can 45, FIGS. 3, 4, 5 and 6, having a side wall 46 and a bottom 48 and top 49. The can is seated in the chamber 16 with its bottom resting on an annular shoulder 50, FIG. 5, at the junction of the chambers 16 and 18 upon a sealing ring 52 set into a shallow groove 54 at the top side of the shoulder. The can 45 is clamped tight against the sealing ring by means of a saddle plate 55 held in clamping engagement with the top of the can by bolts 58 which are threaded into posts 60 integral with and rising from the floor of the chamber 16. The saddle plate 55 contains an opening 57 through which the lead wires extend from the top of the can to the terminal blocks.

The bottom 48 of the can comprises a flexible metal membrane 62, FIGS. 5 and 6, sandwiched between upper and lower rigid plate members 64,66, the latter being of somewhat larger overall area than the plate 64 so as to underlie the lower edge of the wall 46 for welding to the lower end of the can.

Figure 8:
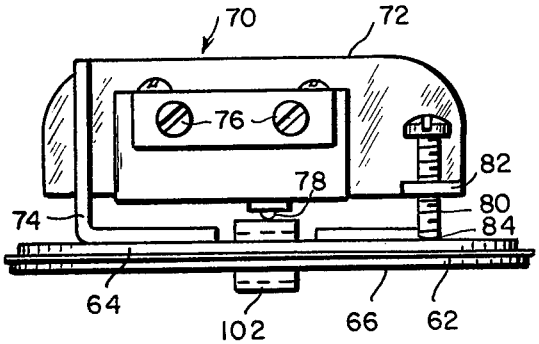
FIG. 8 is an elevation taken on the line 8—8 of FIG. 7.

A pair of switch mounting brackets 70—70, FIGS. 5, 7 and 8, comprising arms 72—72 connected at one end to the supporting legs 74—74 are fastened by welding the legs 74—74 to the upper rigid plate member 64, FIG. 8, with their arms 72—72 in spaced, parallel relation at opposite sides of the center of the rigid plate member. The switches S1,S2 are fastened to the arms 72—72 by screw bolts 76 and, in this position, the actuating pins 78—78 of the switches are supported above the rigid plate member 64 in spaced relation thereto. At the distal ends of the arms 72—72, there are adjusting screws 80—80 threaded through flanges 82—82 at the distal ends of the arms with their lower ends 84—84 engaged with the rigid plate member 64 so that, by rotating the screws 80—80, the actuating pins 78—78 of the switches may be adjusted relative to the surface of the rigid plate 64. When two snap switches S1,S2 are used, they are separated from each other within the can by a piece of insulation 86, FIG. 6, placed diametrically of the can between the supporting arms 72—72 so that the respective circuits of the two switches are isolated from each other. A grounded barrier plate 85 is mounted between the terminal blocks 44—44 to isolate one from the other. The lead wires 42—42 of the snap switches S1,S2 extend upwardly therefrom through headers 87—87 set into openings in top 49 which is welded into the open upper end of the can and through the opening 57 in the saddle plate 55 to the terminal blocks 44—44. The microswitches S1,S2 and their lead wires 42—42 are hermetically sealed within the can by welding of the bottom and top structures to the upper and lower ends of the side wall. Before welding the top into the can, a body of epoxy resin 92 is molded about the portions of the lead wires extending downwardly from the undersides of the headers to seal their passage through the headers and to provide insulation after welding the top in place, the upper side of the top which is cup-shaped is filled with epoxy resin. The portions of the lead wires 42—42 which extend through the top of the can are thus completely embedded and sealed in the epoxy resin so that no uncovered portions of the lead wires are exposed. The hermetically-sealed can suppresses arcing and corrosion.

Figure 9:
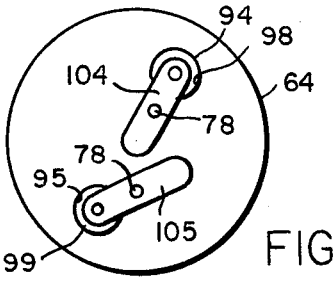
FIG. 9 is a plan view to much smaller scale as seen from the bottom of FIG. 6.
Figure 10:
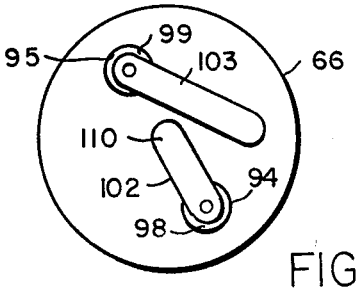
FIG. 10 is a plan view to the same scale as FIG. 9 as seen from the upper side of the bottom of FIG. 6.

As was previously explained, the control can be provided with one or two microswitches S1,S2. When only one switch is used, the rigid plate members 64,66 are provided with one pair of concentric openings 94—94, FIGS. 6, 9 and 10, within which is exposed a portion 98 of the membrane 62. A pair of lever arms comprising a lower lever arm 102 and an upper lever arm 104 provided with end portions 106 and 108 extending into the openings are welded to the membrane 62 so oriented that the distal end 110 of the lever arm 102 lies at the center of the bottom and a portion of the lever arm 104 underlies the switch pin 78 of the switch S1. Pressure applied to the distal end of the lower arm 102 to displace the latter upwardly will thus, through the intermediary of the bottom membrane, effect a corresponding upward displacement of the upper lever arm 102 and, hence, actuation of the switch S1. When the pressure is removed, the inherent elasticity of the membrane will restore it to its undisplaced condition, thus separating the upper arm from the switch pin. If a second switch S2 is used, plate members 64,66 are provided with a second pair of concentric openings 95—95 which expose a portion 99 of the membrane 62. A pair of lever arms comprising a lower lever arm 103 and an upper lever arm 105 provided with end portions 107,109 extending into the openings are welded to the membrane at angles to the lever arms 102,104 with a portion of the lever arm 105 underlying the switch pin 78 of the switch S2.

The provision of pairs of lever arms located interiorly and exteriorly of the bottom of the sealed can provide in conjunction with the kinematic means described hereinafter for transmitting the response of the sensing means to a change in ambient pressure or temperature to the switches for actuating the same without penetration of the can and, hence, without danger of exposing the switch means therein to the corrosive effects of the ambient atmosphere, suppress arcing and also render the switch means less sensitive to extreme temperature changes. The exposed portions of the membranes 62,99 at the bottom of the can serve as elements in transmitting the force applied through the actuator rod from the sensor to the switches.

The sensing means 12 is situated in the chamber 20 and comprises a bellows 119, FIG. 5, one end of which is fixed to a stationary end plate 121 and the other end of which is fixed to a movable end plate 123. The bellows is mounted within the chamber 20 with its stationary end plate which contains a center opening 125 threaded onto the lower end of a threaded sleeve 127 which, in turn, is threaded into a threaded opening 129 in the wall which separates the chamber 18 from the chamber 20. A coiled spring 131 mounted within the bellows with one end resting against a washer 133 at the lower end of the sleeve 127 and its other end seated in a groove 135 in the movable end member 123 holds the bellows extended. Pressure supplied through the coupling 32 to the chamber 20 will compress the bellows in proportion to the resistance of the spring 131.

For use with a single switch S1, the kinematic means 14 for transmitting the displacement of the bellows of the sensing means to the microswitch S1 may comprise, FIG. 5, a rigid rod 178 supported within an opening 180 defined by the sleeve 127 with its lower rounded end 182 resting on the movable end member 123 and with its upper end adjacent the lower side of the bottom of the can in a position to actuate the lower lever arm 102. The sleeve 127 is adjustable by rotation to raise and lower the rod 178 relative to the lower lever arm, thereby to control the pressure required to actuate the switch. A notched disk 139 fixed to the upper end of the sleeve 127 provides for indexing the sleeve relative to a graduated scale 235, FIG. 4. One side of the scale is graduated in kilograms and the other in pounds. The sleeve is locked in its adjusted position by a ball 143 held in engagement therewith by a screw 141.

Figure 11:
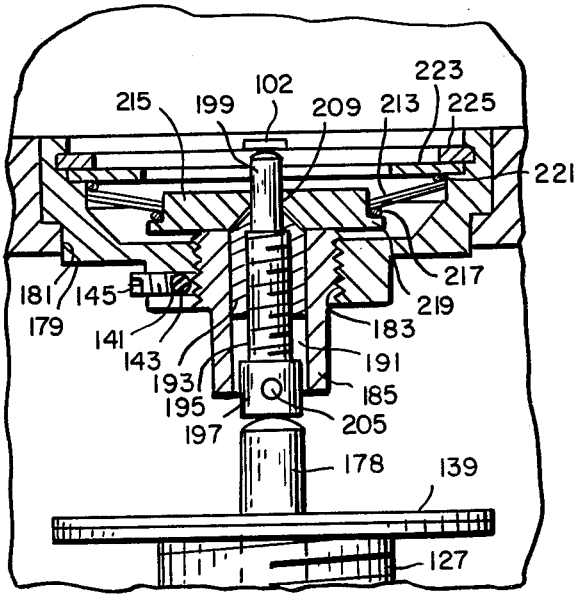
FIG. 11 is a fragmentary section of a Belleville washer assembly employed in the kinematic train for transmitting movement of the sensor actuator rod to the switches.

Alternatively, the kinematic means 14 includes a Belleville washer assembly, FIG. 11, interposed between the actuator rod 178 and the lower lever arm 102. The Belleville washer assembly comprises a cup 179 set into an opening 181 at the bottom of the chamber 16 concentric with and below the bottom of the can. The cup 179 contains a central opening 183 within which is threaded a sleeve 185. The sleeve 185 contains a polygonal opening 191 and a correspondingly-shaped bushing 193 is mounted to the opening upon a threaded spindle 195 having at its lower end a head 197 and at its upper end a pin 199. The head 197 rests on the upper end of the actuator rod 178. The sleeve 185 is fixed in a predetermined position of adjustment within the opening 183 by means of a ball 143 seated against it within an opening 141 by a screw 145. The head 197 of the spindle contains an opening 205 by means of which it may be rotated within the bushing 193 to raise and lower the pin 199 with respect to the bottom of the can to thus provide for a zero setting. The sleeve 185 projects upwardly into the bottom of the cup and supports therein an actuating guide 215 containing a central hole 209 through which the upper end of the pin 199 projects. An actuating disk 213 is seated at its inner edge on a ring 217 mounted on an annular ledge 219 at the base of the guide and with its outer edge resting against a ring 221 supported at the inner side of the cup by a washer 223 and a lock ring 225. The actuator disk 213 holds the guide 215 seated against the upper end of the sleeve, thus holding the pin 199 away from the lower lever arm. When the actuator rod 178 is raised sufficiently to overcome the bias of the actuator disk 213, the guide will be propelled upwardly at a rapid rate, allowing the pin 199 to follow and, by impact with the lower lever arm, actuate the switch in the can. The actuator rod 178 follows movements of the guide and holds the pin in engagement with the lower lever arm 102 at a constant pressure until the pressure drops below a predetermined pressure, whereupon the actuator disk is snapped back to its initial position and simultaneously moves the pin 99 away from the lower lever arm. The pressure at which snap action of the actuator disk will take place is obtained by varying the force applied to it and therefore is not distance-oriented. This is achieved by rotating the sleeve 185 to raise or lower the guide 215 relative to the bottom of the cup. The action obtained by the use of the Belleville assembly is in contrast to normal sensor movement wherein the operating and release forces on the switch increase and decrease to zero at a gradual rate. The design, therefore, is much more vibration-resistant as the constant force eliminates the susceptibility of the switch contacts to bounce as the force approaches zero.

Figure 12:
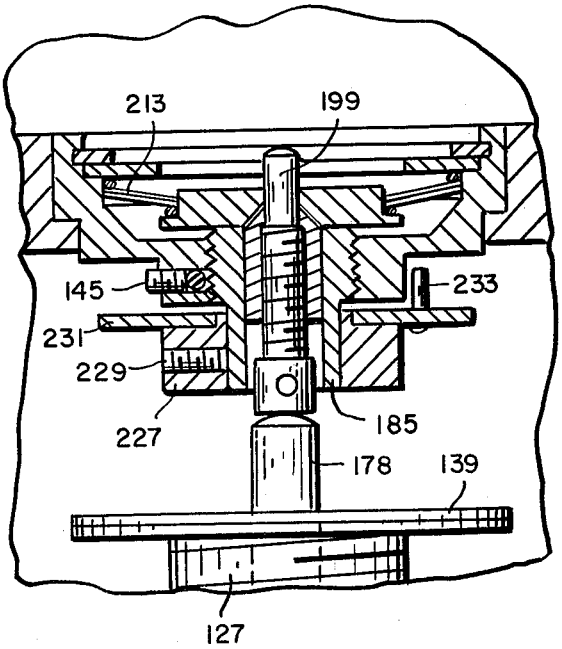
FIG. 12 is a view similar to FIG. 11 showing a Belleville washer assembly provided with means for adjusting its response to pressure.
Figure 13:
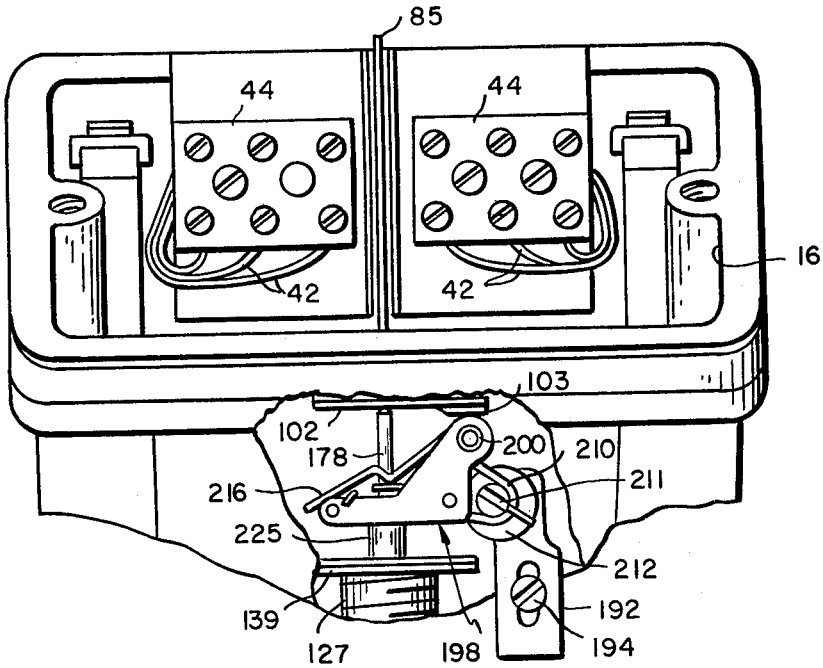
FIG. 13 is a fragmentary elevation of the device with the cover removed and broken away in part to show a lever assembly for transmitting movement of the actuator rod to a pair of switches simultaneously or sequentially.
Figure 14:
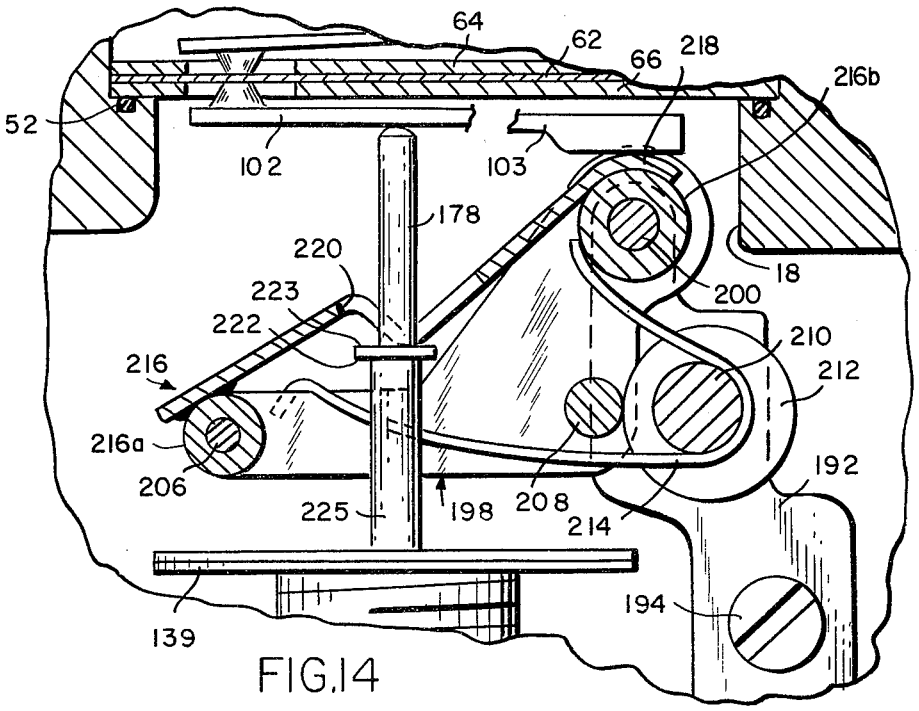
FIGS. 14 and 15 are fragmentary elevations to much larger scale of the lever assembly shown in FIG. 13.
Figure 15:
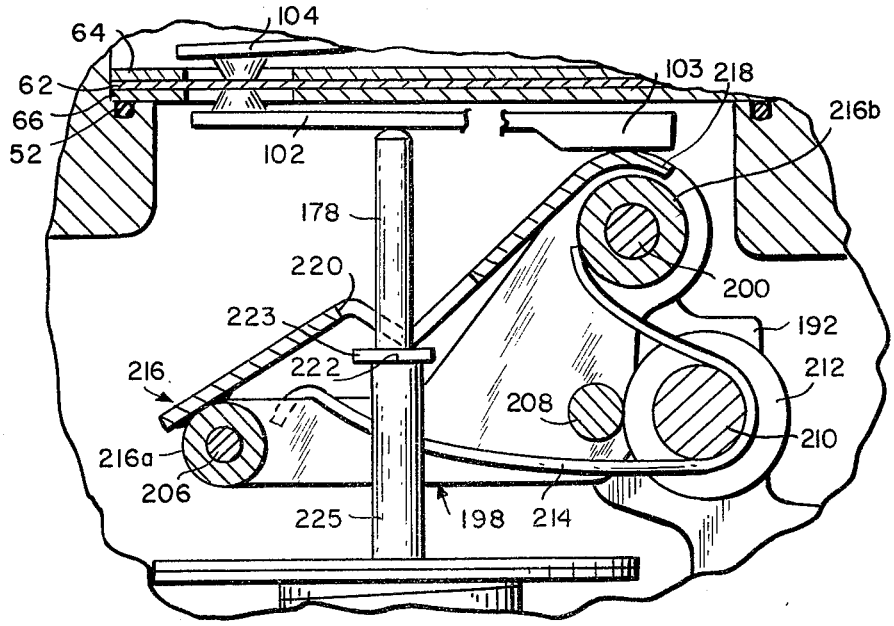
Figure 16:
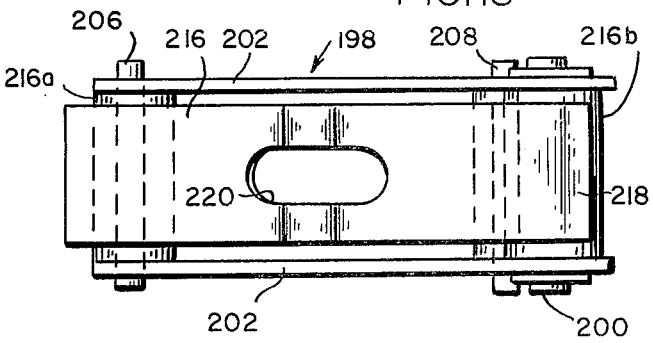
FIG. 16 is a plan view of the lever assembly shown in FIGS. 13–15.
Figure 17:
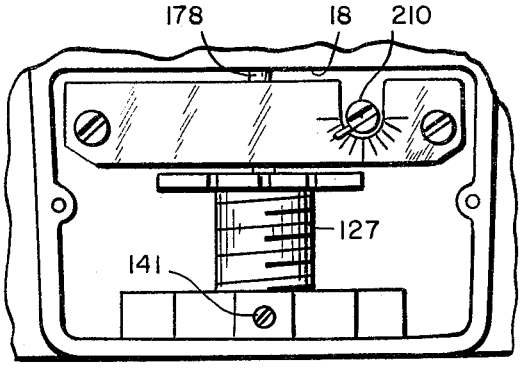
FIG. 17 is a fragmentary elevation of the device illustrated in FIG. 13 with the scale plate mounted therein.

The structure shown in FIG. 11 is fixed, that is, the adjustment of the sleeve 185 is carried out at the place of manufacture. However, it may be made to be adjustable at its place of installation, as shown in FIG. 12 and, to this end, a calibrated collar 227 is secured to the lower end of the sleeve 185 by a screw 229. Rotation of the collar 227 is effected by means of a slotted disk 231 fastened to its upper side, the latter being provided with a vertically-mounted pin 233 so as to limit rotation of the disk to one complete turn in either direction.

When two switches are used, the kinematic means is designed to operate the switches S1,S2 simultaneously or sequentially and, for this purpose, there is provided in place of the Belleville assembly in the kinematic train, a rocker assembly, FIGS. 13, 14, 15 and 16, comprising a bracket plate 192 affixed by means of a screw 194 within the chamber 18 which mounts a rocker 198 for pivotal movement on a pin 200 fixed at one end to the bracket plate 192 in a horizontal position. The rocker 198 comprises spaced, parallel arms 202—202, FIG. 16, pivoted at one end to the pin 200 and joined intermediate their ends and at their ends by pins 206 and 208. A pin 210 also mounted to the bracket plate in a horizontal position and parallel to the pin 200 has on it an eccentric cam 212 which is yieldably held against the pin 208 by spring means 214. The pin 210 contains a slot 211 to enable rotating it and the cam 212 to thus vary the position of the rocker. A lever arm 216 is fixed at one end to a sleeve **216*a* pivotally mounted on the pin 206 for pivotal movement about the axis of the pin 206 and is provided at its other end with a bent end 218 bent to the curve of a sleeve 216*b* mounted on the pin 200 so that it rests thereon in concentric relation to the axis of the pin 200. The lever arm 216 contains an elongate slot 220 through which the upper end of the actuator rod 178 extends freely. At the lower end of the eccentric cam, the rocker occupies a substantially horizontal position, FIG. 14, and, in this position, the upper end of the actuator rod 178 and the upper bent end 218 of the lever 216 are at the same level and have engagement, respectively, with the distal ends of the lower lever arms of the two microswitches. When using the rocker assembly as thus described, the actuator rod 178 is provided with a shoulder 222 and washer 223, FIGS. 14 and 15, which is larger than the slot 220 so that as the actuator rod moves upwardly, it will move the lever arm correspondingly and both switches will be actuated simultaneously. By rotating the cam, the rocker may be raised with respect to the shoulder and the actuator rod 178 so that the actuator rod, when raised, will actuate the microswitch S1 before it lifts the lever arm 216** to activate the microswitch S2, thus providing for sequential operation of the microswitches.

Desirably, the actuator rod 178 is yieldably mounted within the upper end of a sleeve 225, the lower end of which rests on the movable end piece 123.

The enclosure for the control device as described above provides, by reason of its division into three separate, fully-gasketed chambers, the advantages of watertightness and containment of the operating components in isolation from each other, for adjustment independently of each other and for removal and interchange in any suitable combination independently of each other. The hermetically-sealed switch-containing cup completely isolates the switches from the surrounding environmentals, eliminating contact corrosion and assures containment of electrical arcing. The quick-connect terminal blocks provide for ease of wiring and the grounded barrier between them isolates the electrical connectors of each terminal block and eliminates unnecessary labor and installation costs associated with "pigtail" wiring. The wires may be ended at either or both of the two conduit openings and special conduit fittings and junction boxes are not required. The control unit is particularly suited, for example, for both high voltage shutdown and low voltage alarm functions in a single unit since each circuit enters the control head through a separate conduit for internal terminal block wiring, the grounded barrier between the terminal blocks isolating the circuits from each other.

It should be understood that the present disclosure is for the purpose of illustration only and includes all modifications or improvements which fall within the scope of the appended claims.

I claim:

1. In a control device switch means, a sensor, a kinematic train for transmitting the response of the sensor to a change in ambient condition to effect actuation of the switch means and an enclosure for said compenents comprising the switch means, sensing means and kinematic train, said enclosure being weather-tight and containing chambers within which are, respectively, mounted said switch means, sensing means and a kinematic train, a hermetically-sealed receptacle in the chamber containing the switch means, said switch means comprising two switches, a grounded barrier plate in the chamber containing the hermetically sealed receptacle dividing it into two compartments, each of which contains, in electrical isolation, a terminal block and a conductor therefrom to the switch means in the hermetically-sealed receptacle and means for transmitting operation of the kinematic train to the switch means within the hermetically-sealed receptacle without penetration of the latter.

2. In a control device, an enclosure, a receptacle in the enclosure having a wall portion which separates the portion of the enclosure within which it is located from the remainder of the enclosure, said wall portion being flexibly displaceable by a force applied to one side and which will spring back when the force is removed, said receptacle being hermetically sealed, means mounting a snap switch in the receptacle with its actuator in a position to be actuated by displacement of the flexibly displaceable wall portion, sensing means in the enclosure apart from the flexibly displaceable wall portion and kinematic means arranged between the sensing means and the flexibly displaceable wall portion for transmitting movement of the sensing means in one direction to apply a force to said one side of the flexibly displaceable portion of the wall and in the other direction to permit the flexibly displaceable wall portion to restore itself to its undeflected condition, and said flexibly displaceable wall portion constituting a link in the kinematic means for transmitting said force from one side of the wall to the other without penetration of the wall such that the snap switch is isolated from the ambient atmosphere.

3. A control device comprising in combination switch means, pressure-operable means and transmitter means for effecting operation of the switch means in response to operation of the pressure-operable means, characterized in that the switch means is hermetically sealed within a capsule and operation of the switch means within the capsule is effected by said transmitter means exteriorly of the capsule by way of an imperforate wall portion of the capsule, at one side of which there is a lever arm attached at one end to the one side with its other end so oriented as to be engageable by the transmitter means and a lever arm attached at one end to the other side with its other end so oriented as to be engageable with the switch means, said lever arms operating to transmit movement of the transmitter means to the switch means.

4. A control device according to claim 3 wherein the lever arm at one side is welded at one end to the one side at a predetermined position so oriented that its opposite end is in a position to be engaged by the transmitter means and wherein the lever arm at the other side is welded at one end to the other side in superimposed relation with the one end of the lever arm at the one side and with its other end in a position to be engaged by the switch means.

5. In a control device, means defining a multi-chamber, weather-tight enclosure, a hermetically-sealed receptacle removably mounted in a first chamber of the enclosure, switch means in the hermetically-sealed receptacle, sensing means in a second chamber of the enclosure and kinematic means in a third chamber of the enclosure located between the hermetically-sealed receptacle in the first chamber and the sensing means in the second chamber, said sensing means being operable to effect displacement of the kinematic means and means mounted to a wall portion of the hermetically-sealed receptacle arranged to be separably engaged with and disengaged from the kinematic means by positioning the hermetically-sealed receptacle in the chamber and removing it therefrom, said last-named means being operable to effect a displacement of a portion of the wall of the receptacle in response to the displacement of the kinematic means and through the intermediary of the displaceable wall portion, to actuate the switch means in the receptable without breach of the integrity of the hermetically-sealed receptacle.

6. In a control device, switch means, a sensor, a kinematic train for transmitting the response of the sensor to a change in ambient condition to effect actuation of the switch means and an enclosure for said components comprising the switch means, sensing means and kinematic train, said enclosure being weathertight and containing chambers within which are, respectively, mounted said switch means, sensing means and kinematic train, a hermetically-sealed receptacle in the chamber within the one of the chambers within which the switch means is situated, said one chamber containing an opening in communication with the chamber containing the kinematic means, said hermetically-sealed receptacle being positioned in its chamber with its bottom covering said opening and constituting a wall dividing the one chamber from the chamber containing the kinematic means and wherein there is means operable by the kinematic train to transmit actuation of the kinematic train in response to the sensing means to effect actuation of the switch means in the hermetically-sealed receptacle exposed through said opening to the kinematic train.

7. A control device according to claim 6 wherein the bottom of the hermetically-sealed receptacle embodies a flexibly-displaceable portion arranged to be displaced by the kinematic means and the switch is arranged to be actuated by displacement of said displaceable portion.

8. A control device according to claim 6 wherein the kinematic train includes a Belleville disk and there is means for adjustably applying pressure thereto to cause the disk to respond to the application of a predetermined pressure.

9. In a control device, an enclosure containing a chamber, a hermetically-sealed receptacle in the chamber, one wall of which separates the chamber from the remainder of the enclosure, said wall embodying a portion which is flexibly displaceable, a snap switch mounted in said hermetically-sealed receptacle in a position such that displacement of the flexible portion of the wall will effect actuation of the snap switch and means for effecting displacement of the flexible portion of the wall comprising sensing means in the enclosure embodying a part movable toward the flexibily displaceable wall portion, a lever arm situated within the receptacle with one end fixed to the flexible wall portion and the other end underlying the switch actuator, a lever arm situated outside of the receptacle with one end fixed to the flexible wall portion at the point of attachment of the lever arm inside the receptacle and the other end in a position to be actuated by said sensing means, said lever arms being operable when actuated by said sensing means in one direction to effect displacement of the flexible portion of the wall and in the other direction to permit the flexible portion of the wall to spring back to its undisplaced condition, and means comprising a Belleville washer for effecting movement of the flexible wall portion to deactivate the switch.

10. Apparatus according to claim 9 wherein the flexible wall portion is imperforate and the lever arms at the one side and the other side are welded to the one side and the other side so that their proximal ends are superimposed and their distal ends positioned to be engaged by the transmitter means and the switch means.

11. A control device according to claim 9 wherein the imperforate wall portion is flexible and wherein the lever arms at the one side and the other side are welded to the one side and the other side so that said ends are superimposed and with their distal ends so positioned as to be engaged by the transmitter means and the switch means.

12. A control device according to claim 11 wherein the switch means embodies a switch pin and the distal end of the lever arm at the other side is arranged to be engaged with the switch pin.

13. A control device according to claim 12 wherein the switch means is adjustable to vary the width of the gap between the distal end of the lever arm at the other side and the switch pin.

14. A control device according to claim 12 wherein the transmitter means is adjustable to vary the width of the gap between the distal end of the lever arm at the one side and the override pin.

15. A control device according to claim 11 wherein the transmitter means means embodies an override pin and the distal end of the lever arm at the one side is arranged to be engaged by the override pin.

16. A control device according to claim 9 wherein the imperforate wall portion of the capsule is at the bottom of the capsule and comprises an inner rigid plate, an outer rigid plate, and a flexible metal membrane sandwiched therebetween and wheein the inner and outer plates contain concentric openings exposing a portion of the flexible metal membrane and the proximal ends of the lever arms are welded to the opposite sides of the exposed portion of the membrane so that displacement of the distal end of the lever at one side effects displacement of the lever arm at the other side.

17. A control device according to claim 16 wherein the lever arms diverge from their place of weldment to the membrane relative to the plane of the bottom of the capsule.

18. A control device according to claim 16 wherein the switch means comprise two switches, each having a switch pin mounted to the inner rigid plate at the bottom of the capsule and said inner and outer rigid plates contain diametrically arranged pairs of concentric openings, two pairs of inner and outer lever arms with the proximal ends welded to the exposed portions of the membrane within said openings and with the distal ends of the lever arms at the other side in a position to engage the switch pins and means at the one side operable by the transmitter means for effecting displacement of the distal ends of the lever arms at the one side simultaneously or sequentially.

19. In a control device, an enclosure containing chambers separated by walls, switch means, sensing means and kinematic means mounted in the respective chambers, said chambers separating said components from each other, but permitting access to each independently of the other, a flexibly displaceable wall separating one of the chambers from the others, a flexibly displaceable wall having a flexible portion exposed at one side to the chamber containing the switch means and at its other side to the chamber containing the kinematic means such that actuation of the kinematic means through the intermediary of the flexibly displaceable wall portion will effect operation of the switch means in the chamber containing the switch means, said means being situated between the sensing means and the switch means and means in said kinematic train comprising a Belleville washer actuatable at a predetermined pressure to spring from an inoperative to an operative position and wherein when the pressure drops below said predetermined pressure, the Belleville washer springs back to its inoperative position and means operable by movement of the Belleville washer to said operative position to displace the flexible wall portion.

* * * * *